US005322420A

United States Patent [19]

Yannascoli

[11] Patent Number: 5,322,420

[45] Date of Patent: Jun. 21, 1994

[54] HORIZONTAL ROTARY COMPRESSOR

[75] Inventor: Donald Yannascoli, Manlius, N.Y.

[73] Assignee: Carrier Corporation, Syracuse, N.Y.

[21] Appl. No.: 986,323

[22] Filed: Dec. 7, 1992

[51] Int. Cl.[5] ..... F04B 17/00

[52] U.S. Cl. ..... 417/366; 417/368

[58] Field of Search ..... 417/366, 367, 368, 369, 417/370, 371, 902; 418/88, 188; 184/6.16, 6.22

[56] References Cited

U.S. PATENT DOCUMENTS

| | | | |
|---|---|---|---|
| 3,897,178 | 7/1975 | Palloch | 417/369 |
| 4,544,338 | 10/1985 | Takebayashi et al. | 417/368 |
| 4,557,677 | 12/1985 | Hasegawa | 417/368 |
| 4,561,829 | 12/1985 | Iwata et al. | 417/368 |
| 4,759,698 | 7/1988 | Nissen | 418/88 |
| 4,781,542 | 11/1988 | Ozu et al. | 417/369 |
| 5,060,759 | 10/1991 | Dussourd et al. | 184/6.16 |

*Primary Examiner*—Richard A. Bertsch
*Assistant Examiner*—Alfred Basichas

[57] ABSTRACT

In a horizontal rotary compressor the gas passes from the discharge chamber and enters the eccentric shaft bore by passing through an annular space defined between the inlet of the eccentric shaft bore and the discharge end of the oil pickup tube. As a result, a jet pump is created delivering oil from the sump to the axial bore of eccentric shaft bore. Because the eccentric shaft is rotating, oil tends to collect on the walls of the bore and feeds radial lubrication passages which act as centrifugal pumps with the shaft rotating. The discharge flow passing through the eccentric shaft bore impinges upon the shell cover thereby diverting 180° and passes through the annular space between the rotor and stator before being discharged from the compressor.

4 Claims, 2 Drawing Sheets

HORIZONTAL ROTARY COMPRESSOR

BACKGROUND OF THE INVENTION

Hermetic compressors are most commonly operated in a vertical orientation so that lubrication for the shaft, bearings, running gear, etc., is, typically, supplied by a passive centrifugal pump incorporated into the drive shaft. Oil is drawn from a sump which is located at the bottom of the compressor shell and enters the pump through an orifice in the bottom of the shaft. The parts requiring lubrication are, normally, no more than a foot or so above the oil level of the sump so that a small increase in the oil pressure due to its radial acceleration is sufficient to supply the oil to the required locations. This relatively simple, passive lubrication system is a primary reason why most hermetic compressors are designed to operate in a vertical position.

For many applications, the height of the compressor is a primary factor because of packaging considerations. Very often, the height of an air conditioning, refrigeration or heat pump unit is more important than its width or depth. Accordingly, a distinct advantage could be realized if the compressor could be designed to operate in a horizontal orientation. However, in changing the orientation of a hermetic compressor from a vertical to a horizontal orientation, there are significant changes in the lubrication system and gas flow paths. The motor, cylinder, and running gear will extend below the level of the oil in the sump although it is not necessary that all of the members be exposed to the oil sump. The parts to be lubricated are located no more than a few inches above the sump as opposed to a foot, or more, in a vertical unit, but the drainage paths are shorter and over different parts. The oil sump blocks some normally used gas paths which are used in cooling the motor and in removing entrained oil and some of the drainage paths can contribute to oil entrainment.

SUMMARY OF THE INVENTION

A high side rotary compressor is horizontally oriented which reduces the height by a half as compared to a vertical unit. Since the oil sump is no longer located at what is now an end, the length of the shell can be reduced by the amount necessary to define the sump and to accommodate the oil pickup tube carried by the eccentric shaft. Lubricant is drawn into the crankshaft bore by the discharge flow which is directed into the bore of the crankshaft and coacts with an oil supply tube in the nature of a jet pump to cause oil to be entrained in the discharge flow. Because the crankshaft is rotating, the oil entrained in the refrigerant is separated out and collects on the wall of the bore and is pushed ahead by the flowing refrigerant gas. Radial passages are provided in the crankshaft such that oil passing along the bore is directed through the radial passages by centrifugal force to provide a lubricating function as well as sealing the bearing and removing oil from the discharge flow. The discharge flow may or may not pass through the housing or crankcase before passing through the entire crankshaft length, turning 180°, and passing through the motor and past the crankcase to discharge. The separated oil not delivered for lubrication returns to the main sump by passing between the lower shell and the stator.

It is an object of this invention to reduce oil circulation in a hermetic horizontal rotary compressor.

It is another object of this invention to redirect the compressed refrigerant flow within a hermetic horizontal rotary compressor to reduce oil circulation and improve overall efficiency while maintaining a sufficient lubricant supply within the compressor shell.

It is a further object of this invention to reduce the height and cubage of a hermetic rotary compressor. These objects, and others as will become apparent hereinafter, are accomplished by the present invention.

Basically, lubricant is drawn into the eccentric shaft bore due to a jet pump effect produced by discharge flow entering the bore of the eccentric shaft. Some of the lubricant is forced by centrifugal force through passages leading to the shaft bore and thereby serves to lubricate the device. Excess lubricant flows from the motor end of the shaft bore into the sump via a passage between the shell and the stator. The compressed gas serially passes from the compression chamber into the bore of the eccentric shaft, producing the jet pump effect and, after passing through the bore, the compressed gas turns 180° and passes between the stator and the rotor and then through the discharge to the refrigeration system.

BRIEF DESCRIPTION OF THE DRAWINGS

For a fuller understanding of the present invention. reference should now be made to the following detailed description thereof taken in conjunction with the accompanying drawings wherein.

DESCRIPTION OF THE PREFERRED EMBODIMENTS

Figure 1:
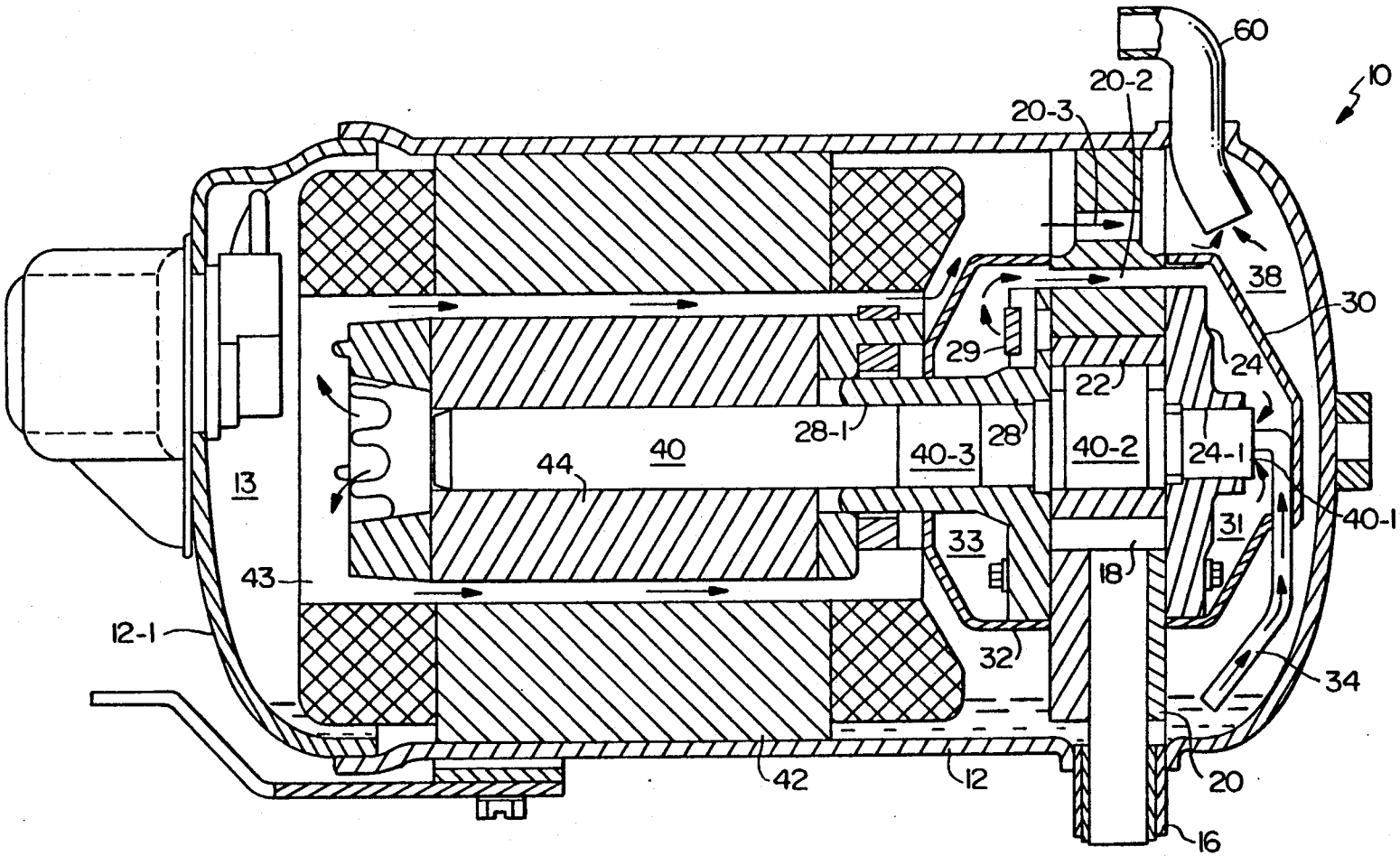
FIG. 1 is a vertical sectional view of a hermetic rotary compressor employing the present invention.
Figure 2:
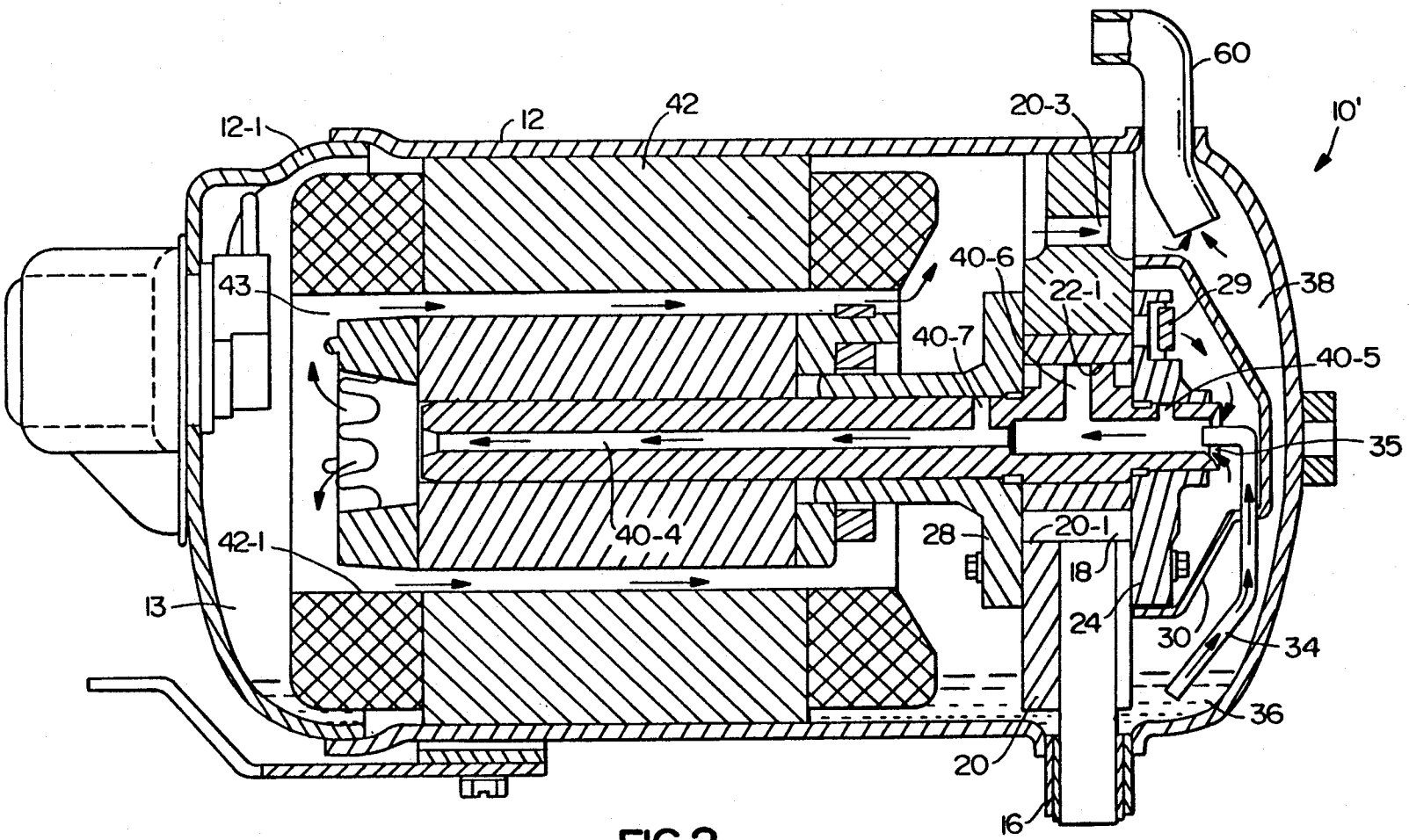
FIG. 2 is a vertical sectional view corresponding to FIG. 1, but showing a modified device.

In FIG. 1, the numeral 10 generally designates a high side hermetic rotary compressor which structurally differs from modified compressor 10' of FIG. 2 in that the discharge flow passes through the crankcase or housing before entering the bore of the eccentric shaft. Thus, while FIGS. 1 and 2 could be presented as essentially identical, with FIG. 2 deleting and moving some structure, it is believed that the presenting of some of the members as unsectioned in one of the Figures results in less cluttered labeling and will aid in understanding. In FIGS. 1 and 2, the numeral 12 generally designates the shell or casing and the numeral 12-1 designates the cover of the casing. Suction tube 16 is sealed to shell 12 and provides fluid communication between a suction accumulator (not illustrated) in a refrigeration system and suction chamber 18. Suction chamber 18 is defined by bore 20-1 in cylinder or crankcase 20, piston 22, pump end bearing 24 and motor end bearing 28.

Oil pick up tube 34 extends from sump 36, through pump end bearing cover 30 and a short way into bore 40-4 of eccentric shaft 40. Shaft 40 is partially located in bore 24-1 of pump end bearing 24. Eccentric shaft 40 includes a portion 40-1 supportingly received in bore 24-1 of pump end bearing 24, eccentric 40-2 which is received in bore 22-1 of piston 22, and portion 40-3 which is supportingly received in bore 28-1 of motor end bearing 28. Stator 42 is secured to shell 12 by welding or any other suitable means. Rotor 44 is suitably secured to shaft 40, as by a shrink fit, and is located within bore 42-1 of stator 42.

In FIG. 1 only, motor end bearing cover 32 is present and is secured to cylinder 20 so as to define therewith chamber 33. Similarly, pump end bearing cover 30 is secured to the opposite side of cylinder 20 so as to define therewith chamber 31. A plurality of circumferentially spaced axially extending passages 20-2, only one of which is illustrated, provide fluid communication between chambers 33 and 31.

In operation of both compressors 10 and 10', rotor 44 and eccentric shaft 40 rotate as a unit and eccentric 40-2 causes movement of piston 22. Piston 22 coacts with a vane (not illustrated) in a conventional manner such that gas is drawn through suction tube 16 to suction chamber 18. The gas in suction chamber 18 is compressed and discharged via discharge valve 29 into chamber 33 of compressor 10 and then passes through passages 20-2 to chamber 31 whereas discharge valve 29 discharges directly into chamber 31 in compressor 10'. In both compressors 10 and 10', discharge gas passes from chamber 31 into bore 40-4 by initially passing through the annular space 35 between the discharge end of oil pickup tube 34 and bore 40-4 for the distance they are generally coaxial, as best shown in FIG. 2. In passing through annular space 35 and over the discharge end of oil pickup tube 34, the discharge gas acts as a jet pump causing the aspiration of oil from sump 36 via tube 34 into the flowing discharge gas in bore 40-4. Because integral shaft 40 and rotor 44 are rotating, the oil entrained by the discharge gas tends to be separated out in a centrifugal separation process which causes the oil to be deposited on the wall of bore 40-4. A plurality of radially extending lubrication passages extend from bore 40-4, exemplified by 40-5, 40-6 and 40-7, to lubricate bearing 24, piston 22 and bearing 28, respectively. The oil deposited on the wall of bore 40-4 is pushed along by the flowing discharge gas. Oil entering bores 40-5, 40-6 and 40-7 is pressurized for lubrication by the centrifugal pumping effect of their rotation as a part of shaft 40.

The excess oil flows from bore 40-4 and either passes downwardly over the rotor 44 and stator 42 to the bottom of chamber 13 or is carried by the gas flowing from annular gap 43 and impinges and collects on the inside of cover 12-1 before draining to the bottom of chamber 13. Because it is upstream in the discharge flow path, chamber 13 is at a higher pressure than chamber 38 so that oil draining to the bottom of chamber 13 will flow along the bottom of shell 12 into sump 36 via a continuous path defined by one or more grooves (not illustrated) which are located in stator 42 as well as in cylinder 20. Further, because chamber 38 is at a lower pressure, the level in sump 36 can be higher than it otherwise might be during operation.

After impinging on the inside of cover 12-1, the essentially oil free, high pressure refrigerant gas completes a 180° turn and passes from chamber 13 via annular gap 43 between the rotating rotor 44 and stator 42 thereby cooling the motor. Due to the rotation of rotor 44, gas passing through gap 43 tends to be subjected to being diverted into a spiraling path which serves to centrifugally separate the remaining entrained oil which will tend to be collected on the wall of bore 42-1 and forced along by the gas. Gas passing from gap 43 will then pass through passage(s) 20-3 into chamber 38 and out discharge line 60 for delivery to the refrigeration system (not illustrated).

Oil distributed to the bearings 24 and 28 and piston 22 for lubrication may drain to the sump 36 or collects at the bottom of chamber 31 and/or 33 and drains therefrom via drain holes (not illustrated). The oil collecting at the bottom of chambers 31 and/or 33 will be out of the discharge flow path and will not tend to be readily entrained.

Although preferred embodiments of the present invention have been illustrated and described, other modifications will occur to those skilled in the art. For example, discharge line 60 may be located between the motor and the cylinder. It is therefore intended that the present invention is to be limited only by the scope of the appended claims.

What is claimed is:

1. A high side horizontal rotary compressor means comprising:

a shell having a first end and a second end;

a cylinder containing a pump including a piston and fixedly located in said shell near said first end and defining with said first end a first chamber which has an oil sump located at the bottom thereof;

bearing means secured to said cylinder and extending towards said second end;

a cover located in said first chamber and secured to said cylinder so as to define a third chamber fluidly separated from said first chamber;

motor means including a rotor and a stator;

said stator fixedly located in said shell between said cylinder and said second end and axially spaced from said cylinder and said bearing means;

said stator defining a second chamber with said second end;

an eccentric shaft supported by said bearing means and including an eccentric operatively connected to said piston;

said shaft having a generally axially extending bore providing fluid communication between said third chamber and said second chamber and at least one generally radially extending lubrication passage communicating with said bore and acting as a centrifugal pump;

said rotor secured to said shaft so as to be integral therewith and located within said stator so as to define therewith an annular gap;

suction means for supplying gas to said pump;

discharge means fluidly connected to said first chamber;

oil pickup tube means extending from said oil sump, through said cover to said shaft means and coacting therewith so as to define jet pump means when discharge gas flows there past into said bore whereby when said motor means is operating a discharge fluid flow path means for the pressurized discharge gas supplied by said pump serially includes said third chamber, said bore, said second chamber, said annular gap and said discharge means.

2. The compressor of claim 1 further including a cover overlying said bearing means and secured to said cylinder so as to define a fourth chamber fluidly separated from said first and second chambers;

additional fluid path means connecting said fourth and third chambers; and said discharge fluid flow path means further including said fourth chamber and said additional fluid path means upstream of said third chamber.

3. The compressor claim 1 wherein flow through said annular gap serves to cool said motor means.

4. A method for lubricating, reducing oil circulation and for cooling motor structure in a horizontal high side compressor comprising the steps of:

passing all compressed gas into a generally axial bore in an eccentric shaft by passing over a delivery end of an oil pickup tube whereby a jet pump is defined causing oil from a sump to be entrained in said compressed gas entering said bore;

centrifugally separating oil from said compressed gas in said bore;

delivering said separated oil to lubrication distribution means for lubricating said compressor;

diverting gas passing from said bore and serially passing said diverted gas through an annular gap between the rotor and stator of a motor to discharge means.

* * * * *